US005527215A

United States Patent [19]

Rubino et al.

[11] Patent Number: 5,527,215

[45] Date of Patent: Jun. 18, 1996

[54] FOAM BUFFING PAD HAVING A FINISHING SURFACE WITH A SPLASH REDUCING CONFIGURATION

[75] Inventors: Joseph P. Rubino, Woodstock; James F. Kosla, Schaumburg, both of Ill.

[73] Assignee: Schlegel Corporation, Rochester, N.Y.

[21] Appl. No.: 896,690

[22] Filed: Jun. 10, 1992

Related U.S. Application Data

[63] Continuation-in-part of Ser. No. 819,269, Jan. 10, 1992, abandoned.

[51] Int. Cl.[6] ..... B24D 11/00; B24D 13/14

[52] U.S. Cl. ..... 451/527; 451/528

[58] Field of Search ..... 51/394, 398, 395, 51/404, 406, DIG. 34; 451/526, 527, 530, 536, 538; 15/230.16

[56] References Cited

U.S. PATENT DOCUMENTS

| | | | |
|---|---|---|---|
| 1,953,983 | 4/1934 | Benner | 51/280 |
| 2,564,217 | 8/1951 | Taylor | 51/209 R |
| 2,653,428 | 9/1953 | Fuller | 51/395 |
| 2,826,015 | 3/1958 | Osenberg | 51/395 |
| 3,146,560 | 9/1964 | Hurst | 51/395 |
| 3,196,586 | 7/1965 | Brown et al. | 51/394 |
| 3,540,160 | 1/1967 | De Rose | 51/394 |
| 4,291,508 | 9/1981 | Prunier | 51/395 |
| 4,437,269 | 3/1984 | Shaw | 51/394 |
| 4,617,767 | 10/1986 | Ali | 51/406 |
| 4,726,718 | 2/1988 | Meskin et al. | 51/206 R |
| 4,841,680 | 6/1989 | Hoffstein | 51/395 |
| 5,007,128 | 4/1991 | Englund | 51/394 |
| 5,007,207 | 4/1991 | Phaal | 51/206 R |
| 5,036,630 | 8/1991 | Kaanta | 51/322 |
| 5,174,795 | 12/1992 | Wiand | 51/394 |

FOREIGN PATENT DOCUMENTS

| | | | |
|---|---|---|---|
| 0004454 | 10/1979 | European Pat. Off. . | |
| 1318689 | 1/1963 | France | 51/394 |
| 2342869 | 3/1975 | Germany | 51/394 |
| 542487 | 4/1956 | Italy . | |
| 48301 | 1/1983 | Japan . | |
| 48310 | 10/1983 | Japan . | |

*Primary Examiner*—Bruce M. Kisliuk
*Attorney, Agent, or Firm*—Cumpston & Shaw

[57] ABSTRACT

A rotatable foam buff for more efficient application of a finishing liquid to the surface of a workpiece. Excess finishing liquid is precluded from being thrown out from the perimeter of the rotating buff pad, due to centrifugal force, by the configuration of the finishing surface of the pad which includes one or more grooves located wholly within the perimeter of the pad, or, recessed regions that form a groove when pressure is applied to the back of the pad. The groove(s) captures potentially escaping finishing liquid which is then absorbed by the foam pad.

19 Claims, 4 Drawing Sheets

FOAM BUFFING PAD HAVING A FINISHING SURFACE WITH A SPLASH REDUCING CONFIGURATION

This is a continuation-in-part of application Ser. No. 07/819,269, filed Jan. 10, 1992, now abandoned for Foam Buffing Pad Having a Finishing Surface with a Splash Reducing Configuration.

The present invention relates to buffs for applying a finishing liquid to a workpiece, and more particularly, to a foam buff having a grooved or channelled finishing surface for reducing the splatter of finishing liquid during operation of the buff.

BACKGROUND OF THE INVENTION

Foam buffs are used in a polishing operation for finishing various surfaces. The buffs are used with finishing liquids such as glazes or polishing compounds; for example, glazes are often used for removing swirl marks on painted surfaces.

Known buffs include a foam pad having a planar finishing surface substantially perpendicular to the axis of rotation of the buff. The finishing surface is planar over its entire area, and contacts the workpiece to apply the finishing liquid to the workpiece surface.

A grinding disc patented by P. Fuller (U.S. Pat. No. 2,653,428) is similar to the present invention in that the grinding surface of the disc contains grooves or pathways. These grooves, however, extend to and are open to the perimeter of the disc and serve as both escape routes for particulate matter produced by the grinding process and as surface cooling passages as air escapes from them during operation.

Another known device is a foam buff patented by R. Englund, et al. (U.S. Pat. No. 5,007,128), having a waffle finishing surface which is perpendicular to the axis of rotation. The purpose of the surface configuration is to eliminate or reduce the chatter and grabbing between the pad and the workpiece as the pad distributes and absorbs a polishing substance. All prior art rotating buff devices, impart sufficient energy to a substantial quantity of polishing or finishing liquid to throw the liquid material from between the buff and the workpiece. This splattering of finishing or polishing liquid necessitates substantial time and effort in clean-up procedures and such splattering wastes the finishing liquid.

SUMMARY OF THE INVENTION

The buff of the present invention includes a disc shaped foam pad with hook and loop fastener means on its back surface for attaching the pad to a similar type of connective surface which is attached to a shaft for mechanical rotation. The front finishing surface of the pad contains at least one groove which, notably, is contained within the circumference of the disc shaped pad and which can be of a concentrically circular, arcuate, or spiral shape with respect to the circular perimeter of the disc shaped pad. The pad may also contain a plurality of grooves, all of which are wholly contained within the circumference of the pad. The cross sectional shape of each groove is substantially uniform and may be squared, U-shaped, V-shaped, triangular, rectangular, saw-toothed or otherwise.

Alternatively, the pad may have an outer annular front finishing surface and an inner circular front finishing surface, the plane of the inner finishing surface being recessed from the plane of the outer finishing surface by a selected distance. Upon applying pressure to the back surface of the foam pad, the compression of both finishing surfaces against a workpiece surface results in the formation of at least one of the aforementioned grooves in the plane of the compressed finishing surfaces where the sidewall interfaces the inner and outer finishing surfaces.

The configuration, depth, and cross-sectional shape of the groove(s) precludes or substantially reduces the splattering, or throwing outward, of finishing liquid from between the spinning buff pad and the workpiece surface.

The number of grooves for a given pad radius is determined by the application of the pad. It is preferable to employ the fewest number of grooves needed to substantially eliminate splattering of the finishing liquid. Reducing the number of grooves increases the area of the finishing surface that contacts the workpiece, and, thus, increases the life of the pad.

DETAILED DESCRIPTION OF THE PREFERRED EMBODIMENT

Figure 1:
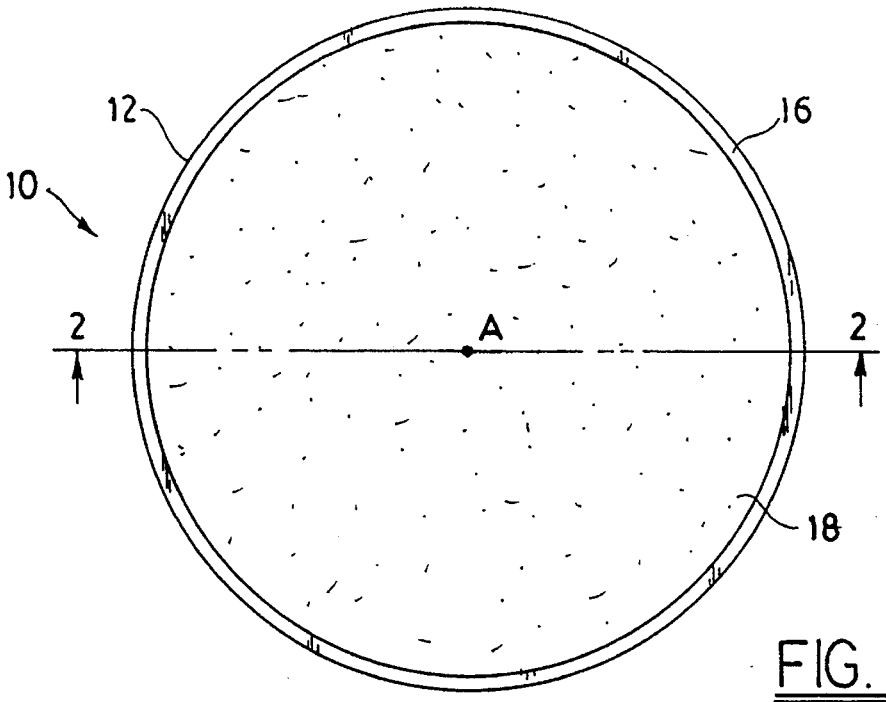
FIG. 1 is a top plan view of the new buff.
Figure 2:
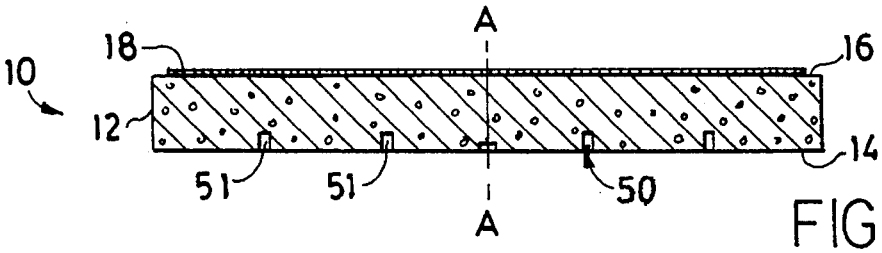
FIG. 2 is a cross-sectional view taken along lines 2—2 of FIG. 1.
Figure 3:
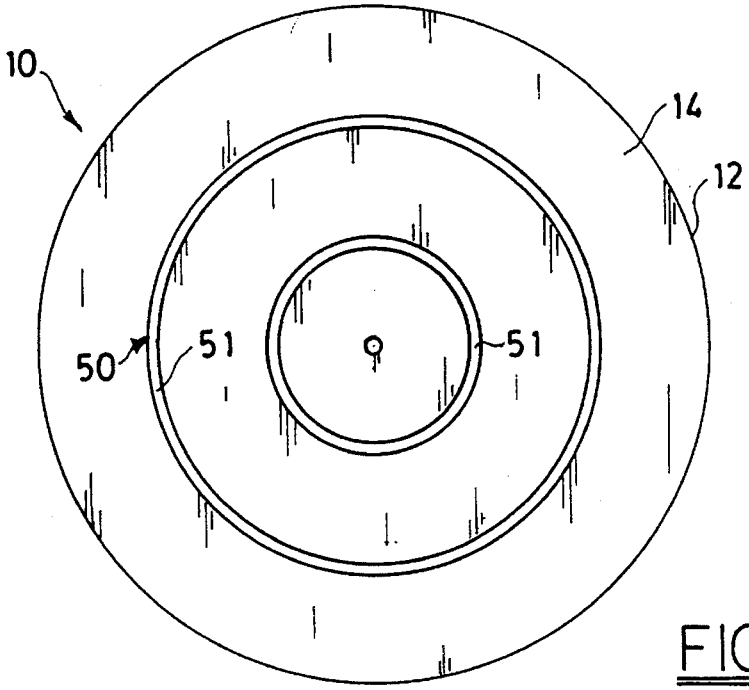
FIG. 3 is a bottom plan view showing the finishing surface of the buff.

Referring to FIGS. 1–3, the buff 10 of the present invention includes a foam pad 12 for rotation about an axis A.

The foam pad 12 is, preferably, one to two inches thick and made from polyester, polyurethane or similar type foam. It is also preferred that the foam have an open cell construction, although a closed cell foam design may be used. The density, weight, cell structure, compression, deflection and other performance characteristics of the pad are dictated by the specific application of the buff.

The weight of the foam pad is, preferably, sufficiently light such that minor eccentricity or deflection of the pad relative to the rotating shaft attachment will not detach the pad.

The foam pad 12 has a circular perimeter that is preferably concentric with the axis of rotation A. The pad 12 has two parallel major surfaces 16,14; one major surface defines a finishing surface 14 and the other major surface defines an engagement surface 16. The finishing surface 14 is perpendicular to the axis A, and circumscribed by the circular perimeter.

The engagement surface 16 includes a hook and loop fastener backed layer 18 such as tricot which is attached to the foam pad 12 by means well known in the art, such as heat bonding, adhesives or stitching. The hook and loop fastener layer 18 cooperates with a complementary hook and loop fastener surface attached to a flat plate mounted on the end of a rotating shaft (not shown) such that the pad 12 may be affixed to the shaft by engagement of the hook and loop fasteners between the engagement surface 16 and the shaft mounting plate.

Referring to FIGS. 2 and 7–9, a groove 50 extends into the pad from the finishing surface 14. The groove is laterally bounded by sidewalls 60 which extend inward from the finishing surface to the floor or base 62 of the groove. The cross-section of the groove 50 is defined by the intersection of the sidewalls 60, which extend into the plane of the finishing surface 14, with the floor 62 of the groove 50. The cross-section of the groove 50 may have a variety of configurations including square, rectangular, triangular, saw tooth, U or V shaped. Preferably, the groove 50 has a sufficient depth and length to substantially preclude the transfer of the finishing liquid beyond the perimeter of the pad 12.

In a preferred embodiment of the invention shown in FIGS. 2 and 3, the buff 10 has an outer diameter of 7.75 in. (19.69 cm.). The finishing surface 14 includes a plurality of concentric circular grooves 51 about the axis of rotation A. The inner groove is approximately 2.7 in. (6.86 cm.) from the axis A; it is approximately 0.20 in. (0.5 cm.) deep and has a radial width of about 0.12 in. (0.3 cm.). The outer groove is approximately 3.1 in. (7.87 cm.) from the inner groove and also is approximately 0.20 in. deep and 0.12 in. in radial width. The outer groove, therefore, is approximately 1.95 in. (4.95 cm.) from the perimeter of the pad 12. The grooves 51, as depicted in FIG. 2, have a square ended, U-shaped cross-section. The cross-section of the groove 50 as shown in FIGS. 2 and 7–9, may, however, have a variety of configurations including square, rectangular, triangular, saw-tooth, U or V shaped.

Figure 6:
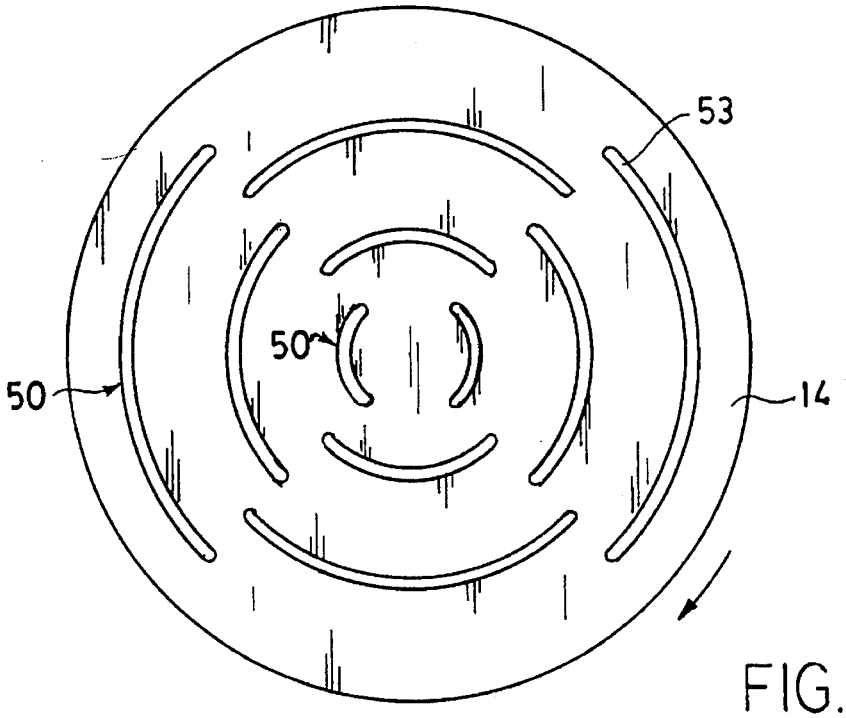
FIG. 6 is a bottom plan view showing an alternative embodiment of the finishing surface.
Figure 7:
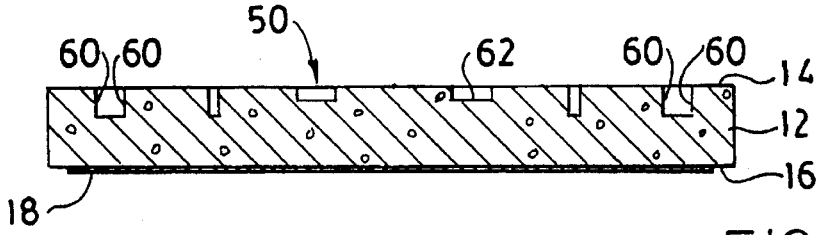
FIGS. 7–9 are cross-sectional views of the buff showing alternative configurations.
Figure 8:
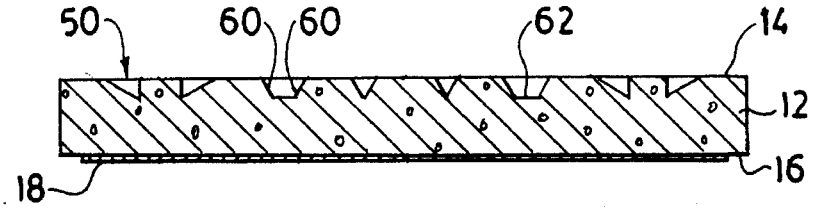
Figure 9:
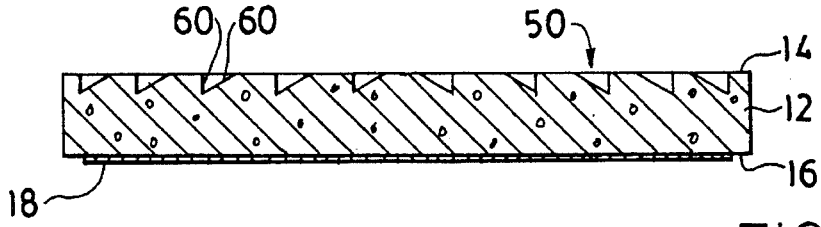

Alternatively, as shown in FIG. 6, the grooves may be in the form of arcuate segments 53 that are either concentric or nonconcentric (not shown) with the axis A. The arcuate segments 53 may be disposed such that a given radius extending from the axis A to the periphery of the pad 12 intersects one, or a plurality of the groove segments. In a preferred embodiment, the groove 50 has a length of at least twice its cross-sectional width.

Figure 4:
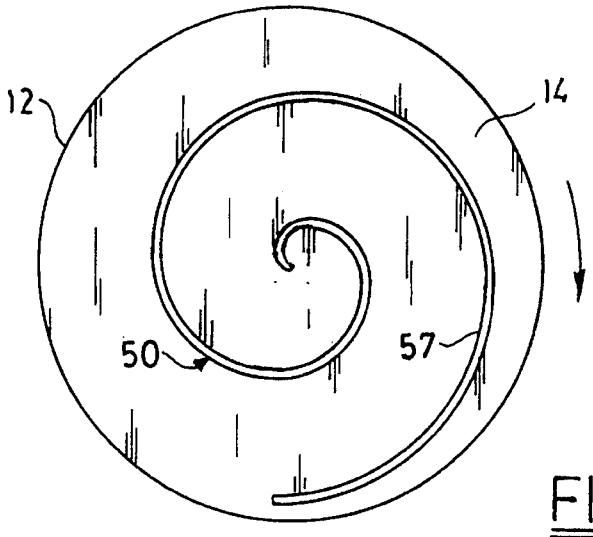
FIG. 4 is a bottom plan view showing an alternative embodiment of the finishing surface.
Figure 5A:
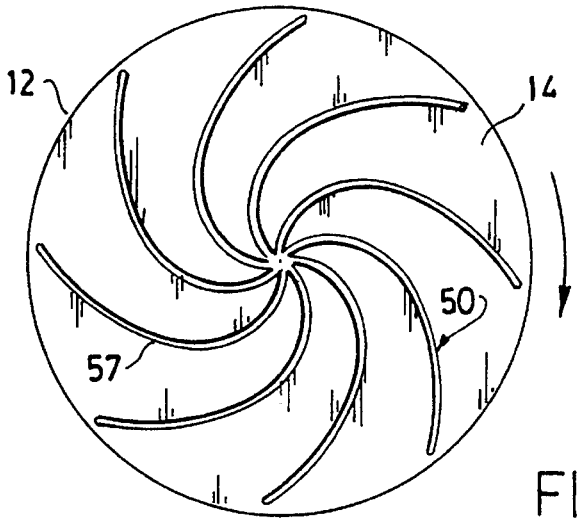
FIGS. 5A and 5B are bottom plan views of alternative embodiments of the finishing surface.
Figure 5B:
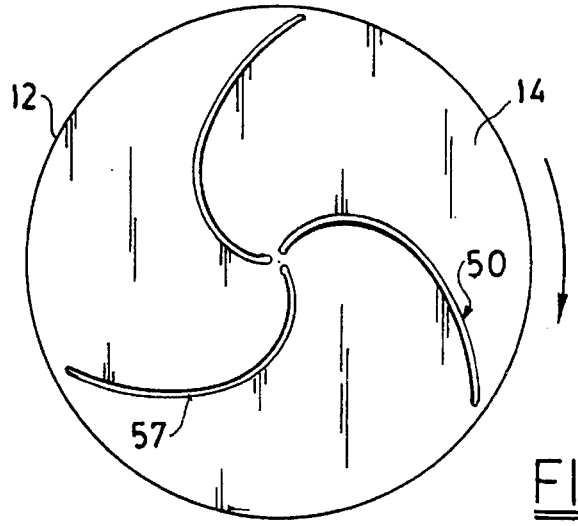

As shown in FIG. 4, 5A and 5B, the grooves may form spirals 57 radiating outwardly from the axis A such that the spiral is open in the direction of rotation of the pad 12; that is, the concave edge of the spiral is the leading edge. The spirals 57 may be configured such that one, two, three or more arms of the spirals will be intersected by any given radius extending from the axis A to the periphery of the pad 12. In no case do non-continuous grooves in the pad intersect the perimeter of the pad.

Figure 10:
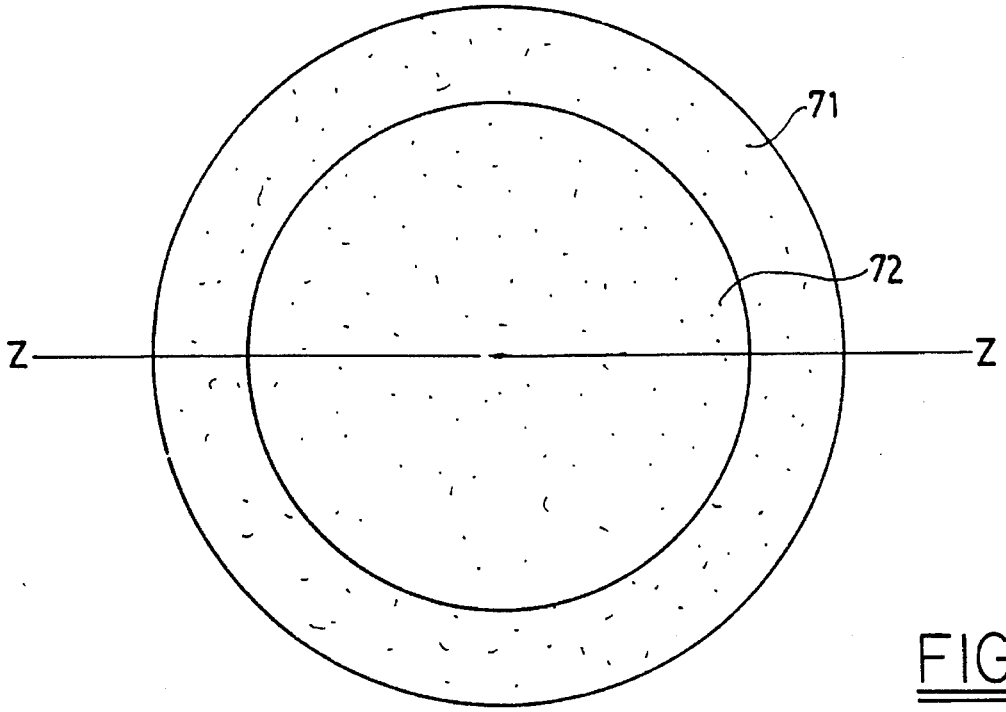
FIG. 10 is a bottom plan view of an alternative embodiment of the finishing surfaces of the buff.
Figure 11:
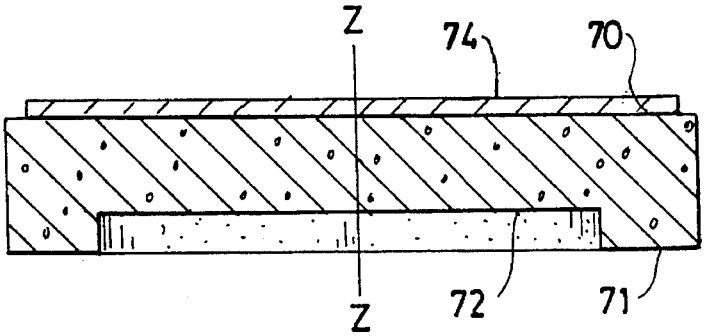
FIGS. 11 and 12 are cross-sectional views of the buff of FIG. 10 depicting the buff absent and under a compression force, respectfully.
Figure 12:
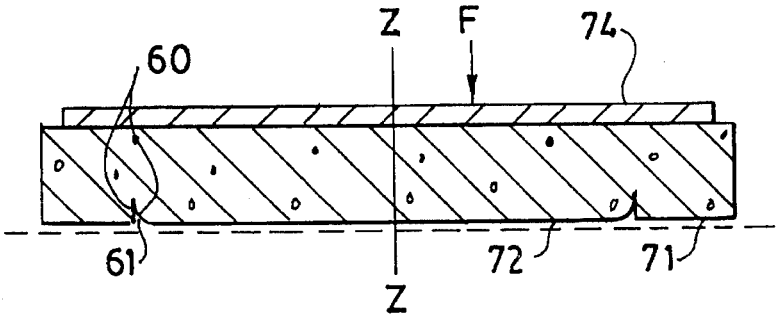

Another embodiment of the buffing pad of this invention is illustrated in FIGS. 10, 11 and 12. The pad is formed from an open cell foam disk having a symmetrical, preferably circular perimeter. The pad has an attaching back planar surface 70 with a hook and loop fastener surface 74 substantially as described before. Opposite the back planar surface are first and second front finishing surfaces 71,72, respectively. The second front finishing surface 72 is recessed from the first front finishing surface 71 by a distance selected so that upon application of an axially directed compression force F to the rear planar surface 70, both the first and second front finishing surfaces 71 and 72 contact the workpiece 73, except where at least one groove 61 is formed between the surfaces. The groove 61 is wholly within the continuous periphery of the pad and is open towards the front finishing surfaces. The cross-sectional shape of the groove 61 will depend on the orientation of a side wall 60 that joins the first front finishing surface to the second front finishing surface 72. The shape of the groove will change from the shape shown in FIG. 11 to a more triangular shape as shown in FIG. 12, as more force F is applied to the back surface of the buff pad.

In accordance with this embodiment of the invention, a polishing pad is provided having a diameter of 7.75 in. (19.69 cm.) and a thickness of 1 in. (2.54 cm.). The second front finishing surface 72 is recessed from the first front finishing surface 71 by between 0.12 in. (0.3 cm.) and 0.5 in. (1.27 cm.), preferably about 0.24 in. (0.6 cm.). The diameter of the second front finishing surface is from 0.75 in. (1.9 cm.) to 5.75 in. (14.6 cm.), preferably about 2.36 in. (6 cm.).

Operation

The buff 10 of this invention is used by attaching the engagement surface 18 of the pad 12 to a corresponding surface of a driving plate mounted on the end of a rotating shaft (not shown). When the pad 12 is so attached, the finishing surface 14 is disposed perpendicular to the axis A. The hook and loop fastener connection between the pad and the plate attached to the shaft sufficiently retains the buff 10 relative to the axis A to preclude unintended disengagement of the pad and the shaft.

The finishing liquid is disposed onto the finishing surface 14, and preferably, not into the grooves 50. The pad 12 is rotated while the finishing surface 14 is brought into contact with the workpiece surface who apply the finishing liquid.

As the finishing liquid contacts the workpiece it is driven to the edge of the pad by centrifugal force. Excess finishing liquid is trapped or captured in the groove 50. The open cell foam pad 12 also absorbs some of the finishing liquid. The grooves 50 provide means for reducing the transfer of finishing liquid to the perimeter of the pad 12.

In an alternative embodiment, a foam buffing pad constructed as described above is deformed during use to produce the configuration shown in FIG. 12. Both the second front finishing surface and the first front finishing surface contact the work piece, and a generally triangular shaped cross-sectional concentric circular groove is formed between the two surfaces. The polishing pad thus functions like those already described, but is substantially simpler to manufacture. In addition, as pressure on the polishing pad is removed, the second front finishing surface disengages from the work piece first, the groove expands to form a substantially larger volume, trapping any residual polishing liquid and further reducing splatter.

While a preferred and alternative embodiment of the invention have been shown and described with particularity, it will be appreciated that various changes and modifications may suggest themselves to one having ordinary skill in the art upon being apprised of the present invention. It is intended to encompass all such changes and modifications as fall within the scope and spirit of the appended claims.

What is claimed is:

1. A buff pad for rotating about an axis to apply a finishing liquid on a workpiece, comprising:

a foam pad having a continuous circumferential perimeter, a planar back surface, and first and second planar front finishing surfaces, said first planar front finishing surface including said perimeter, said second front finishing surface lying in a plane recessed from the plane of the first front finishing surface by a distance selected so that upon application of an axially directed compression force to the back planar surface of the pad, both the first and second planar front finishing surfaces contact the workpiece surface forming at least one groove in the plane of the compressed front finishing surfaces, said groove being open to the plane of the compressed front finishing surfaces and said groove being entirely within the continuous circumferential perimeter of the buff pad.

2. The buff pad of claim 1 wherein the foam pad has an open cell structure.

3. A buff for mechanical rotation about an axis comprising:

a foam pad having a continuous circumferential perimeter, a planar back surface, and first and second planar front finishing surfaces, said first planar front finishing surface including said perimeter and said second front finishing surface lying in a plane recessed from the plane of the first front finishing surface by a distance selected so that upon application of compression force to the back planar surface of the pad, both the first and second planar front finishing surfaces contact a workpiece surface and at least one groove is formed in the compressed front finishing surfaces, said groove being open to the plane of the compressed front finishing surfaces and said groove being entirely within the continuous circumferential perimeter of the buff pad.

4. The buff of claim 3 further comprising means for affixing the pad to a shaft for rotating the planar finishing surfaces of the pad against the surface of the workpiece.

5. The buff of claim 3 wherein the foam pad has an open cell structure.

6. The buff of claim 3 wherein the foam pad has a closed cell structure.

7. A buff for rotating about an axis of a shaft to apply a finishing liquid to a workpiece comprising:

a resilient compressible foam pad having a continuous uninterrupted perimeter, a back surface, and a finishing surface disposed substantially perpendicular to the axis;

the finishing surface having a surface configuration selected so that at least upon application of working pressure to the pad in a direction which intersects the plane of the finishing surface, at least one groove is formed with the perimeter of the finishing surface that contacts the workpiece for capturing finishing liquid in the groove that migrates from the center of the pad towards the perimeter for reducing splatter of the finishing liquid for the perimeter of the pad.

8. The buff of claim 7 wherein the foam pad comprises an open cell structure.

9. The buff of claim 7 wherein the foam pad has a closed cell structure.

10. The buff of claim 7 including a hook and loop fastener layer attached to the back surface of the pad.

11. The buff of claim 7 wherein the finishing surface comprises an outer annular region and an inner circular region.

12. The buff of claim 7 wherein the outer annular region is circumscribed by the continuous uninterrupted perimeter of the pad.

13. The buff of claim 7 wherein the inner circular region is circumscribed by the outer annular region.

14. The buff of claim 7 wherein the inner circular region is recessed from the outer annular region.

15. The buff of claim 14 wherein the recess of the inner circular region is between 0.12 in. and 0.5 in.

16. The buff of claim 7 wherein the pad has a diameter of 7.75 in.

17. The buff of claim 7 wherein the pad has a thickness of about 1.0 in.

18. The buff of claim 11 wherein the outer annular region has an annular width of between about 1.00 in. and 3.53 in.

19. A method of applying a finishing liquid to a surface of a workpiece, comprising:

(a) rotating a compressible foam pad about an axis, the pad having a continuous periphery and a first and a second planar finishing surface for contacting the surface, wherein the second surface is recessed from the first surface;

(b) applying a sufficient pressure to the pad to cause a substantial portion of the first surface and the second surface to occupy a common plane and form a groove in the common plane, the groove being within the periphery.

* * * * *